US006155082A

United States Patent [19]

Schimko et al.

[11] Patent Number: 6,155,082

[45] Date of Patent: Dec. 5, 2000

[54] FLATBED KNITTING MACHINE

[75] Inventors: Reinhold Schimko, Überlingen; Armin Bich, Aalen, both of Germany

[73] Assignee: Shima Seiki Manufacturing Limited, Wakayama, Japan

[21] Appl. No.: 09/403,756

[22] PCT Filed: Apr. 30, 1999

[86] PCT No.: PCT/EP98/02568

§ 371 Date: Oct. 29, 1999

§ 102(e) Date: Oct. 29, 1999

[87] PCT Pub. No.: WO98/49380

PCT Pub. Date: Nov. 5, 1998

[30] Foreign Application Priority Data

Apr. 30, 1997 [DE] Germany ..... 197 18 472

[51] Int. Cl.[7] ..... D04B 15/88

[52] U.S. Cl. ..... 66/149 R

[58] Field of Search ..... 66/147, 148, 149 R, 66/150, 152; 87/31; 139/304

[56] References Cited

U.S. PATENT DOCUMENTS

| | | | |
|---|---|---|---|
| 3,618,343 | 11/1971 | Essig | 66/149 R |
| 4,488,416 | 12/1984 | Shima et al. | 66/149 R |
| 5,040,384 | 8/1991 | Shima | 66/149 R |
| 5,241,841 | 9/1993 | Schmid et al. | 66/149 R |
| 5,899,094 | 5/1999 | Ikoma | 66/149 R |

FOREIGN PATENT DOCUMENTS

| | | | |
|---|---|---|---|
| 20 05 321 | 12/1970 | Germany . | |
| 2005321 | 12/1970 | Germany | 66/149 R |
| 40 03 667 | 8/1990 | Germany . | |
| 4003667 | 8/1990 | Germany | 66/149 R |
| 2 118 216 | 10/1983 | United Kingdom . | |
| 2118316 | 10/1983 | United Kingdom | 66/149 R |

*Primary Examiner*—Danny Worrell
*Attorney, Agent, or Firm*—Arent Fox Kintner Plotkin & Kahn PLLC

[57] ABSTRACT

In a flatbed knitting machine comprising at least two needle beds, at least one knitting system, at least one fabric take-off device and a take-off comb, the comb hooks (2) are covered by a take-off comb covering device (6) during at least one part of the rising motion of the take-off comb (1) so as to prevent previously knitted items from becoming caught up in the take-off comb.

5 Claims, 2 Drawing Sheets

FLATBED KNITTING MACHINE

The invention relates to a flatbed knitting machine including a fabric take-off device and a take-off comb.

Flatbed knitting machines of this type are known for example from Flat Knitting, F. Raz, 1991, Bamberg, especially at pages 143 and 144, and also from DE 20 05 321 A1 or DE 19 09 713 A1. In the past, take-off combs have been used in order to increase productivity and prevent loss of yarn. When the end of the fabric being knitted is reached and the take-off device is open, the take-off combs are moved upwardly in a direction opposite to that in which the fabric will be drawn off in order to allow knitting of the first part of a new, wider or narrower fabric to be immediately started independently of the width of the preceding fabric. The transition regions required for decreasing or increasing the number of stitches between the individual fabrics and thus the time required and the amount of yarn used can thereby be reduced. However, the previously knitted fabric is still in the machine during the upward movement of the take-off comb into its knitting position. As a result, the previously knitted fabric frequently gets caught up and becomes entangled in the take-off comb during its upward movement thus producing defects in the fabric and/or causing the machine to stop.

Another design of take-off comb arrangement is known from DE-A-40 03 667 wherein hook receiving projections are provided in the same manner as in the other known devices for casting off the fabric from the hooks. However, this device too does not prevent the fabric from getting caught up or becoming entangled in the take-off comb during its upward movement.

Consequently, the object of the invention is to produce a flatbed knitting machine in which functional defects and defects in the fabric are prevented even when using a take-off comb.

In accordance with the invention, the object posed above is achieved through the provision of a take-off comb covering device which is controllably moveable relative to the take-off comb (1) and the ejecting element (5) and which covers the comb hooks of the take-off comb during at least one part of the rising motion of the take-off comb. Due to the comb hooks of the take-off comb being covered during its upward motion, it is thereby ensured that the previously knitted fabric, which is still in the knitting machine, will be prevented from getting caught up on the comb hooks so that functional defects in the machine and defects in the fabric will not occur even when using a take-off comb.

By virtue of the flatbed knitting machine in accordance with the invention, it is also possible for example to draw off additional knitted items provided on a fabric such as pockets for example, or to draw off items that were knitted in parallel with the main fabric because, due to its being covered by the take-off comb covering device, the take-off comb can be moved upwardly even in the presence of a main fabric which is being pulled off by a fabric take-off device and can be used to draw off the additional item such as a pocket for example. Thus, due to the take-off comb covering device, the take-off comb will thereby be prevented from hooking onto the main fabric even in cases like this.

In accordance with one advantageous embodiment of the invention, the take-off comb covering device is resilient and snaps over the comb hooks when the take-off comb is covered. As a result of this feature, the comb hooks are also securely and reliably covered during that period when the comb hooks ought to be covered in the course of the upward movement of the take-off comb and, in respect to the fabric hanging in the machine, there are no exposed comb hooks or elements on which the fabric can get caught up. For this same purpose in particular, the take-off comb covering device comprises a cover plate having the desired resilience.

A very advantageous embodiment of the invention is one in which the take-off comb covering device and the take-off comb are moveable relative to one another in the take-off direction. It is thereby easily possible to move the take-off comb covering device into a position where it covers the comb hooks and to free the take-off combs from the take-off comb covering device when they reach their working position should they be required to pick up the initial stitches of the next item to be knitted.

It is preferable, if the comb hooks are not covered by the take-off comb covering device during the downward motion of the take-off comb since the comb hooks then have to perform their draw off function and there is no longer any danger of the previously knitted, finished fabric getting caught up on the comb hooks because this fabric is no longer in range of the take-off combs.

A very advantageous embodiment here, is one in which the take-off comb covering device is halted towards the end of that period of the rising motion that is common to the take-off comb and the take-off comb covering device, i.e. during or at the start of the final period for performing the functions required of the comb hook, the take-off comb itself then continuing with its rising motion. The take-off comb is thereby freed from the take-off comb covering device so as to perform its draw-off function.

In accordance with another advantageous embodiment of the invention, the take-off comb covering device comprises a stopping element which strikes a fixed dog towards the end of that period of the rising motion common to the take-off comb covering device and the take-off comb, such action thereby stopping the rising motion of the take-off comb covering device. This thereby allows the take-off comb to be easily freed from the covering device towards the end of the upward movement by which time a finished fabric will no longer be present and the danger of getting caught up does not therefore exist.

One very advantageous embodiment is one in which a separate motor is provided for moving the take-off comb covering device relative to the take-off comb. By using a motor of this type, it is possible to cover the take-off comb with the take-off comb covering device at any point in the upward or downward movement of the take-off comb. It thereby becomes possible for example, to extend the use of the take-off comb for drawing off additional parts of the fabric which were knitted as an adjunct to the main part of the fabric in the course of a single working step, as in the case of pockets for example. By using a separate drive motor, the take-off comb covering device can be moved relative to the take-off comb during the upwards and downwards movement of the take-off comb while the latter is at any position in its swept range so that it is then possible to cover or free the take-off comb or the take-off hooks in any position thereof.

BRIEF DESCRIPTION OF THE DRAWINGS

The invention will be explained hereinafter in more detail by means of a preferred embodiment taken in conjunction with the Figures. Therein

DESCRIPTION OF THE PREFERRED EMBODIMENT

Figures 1, 2:
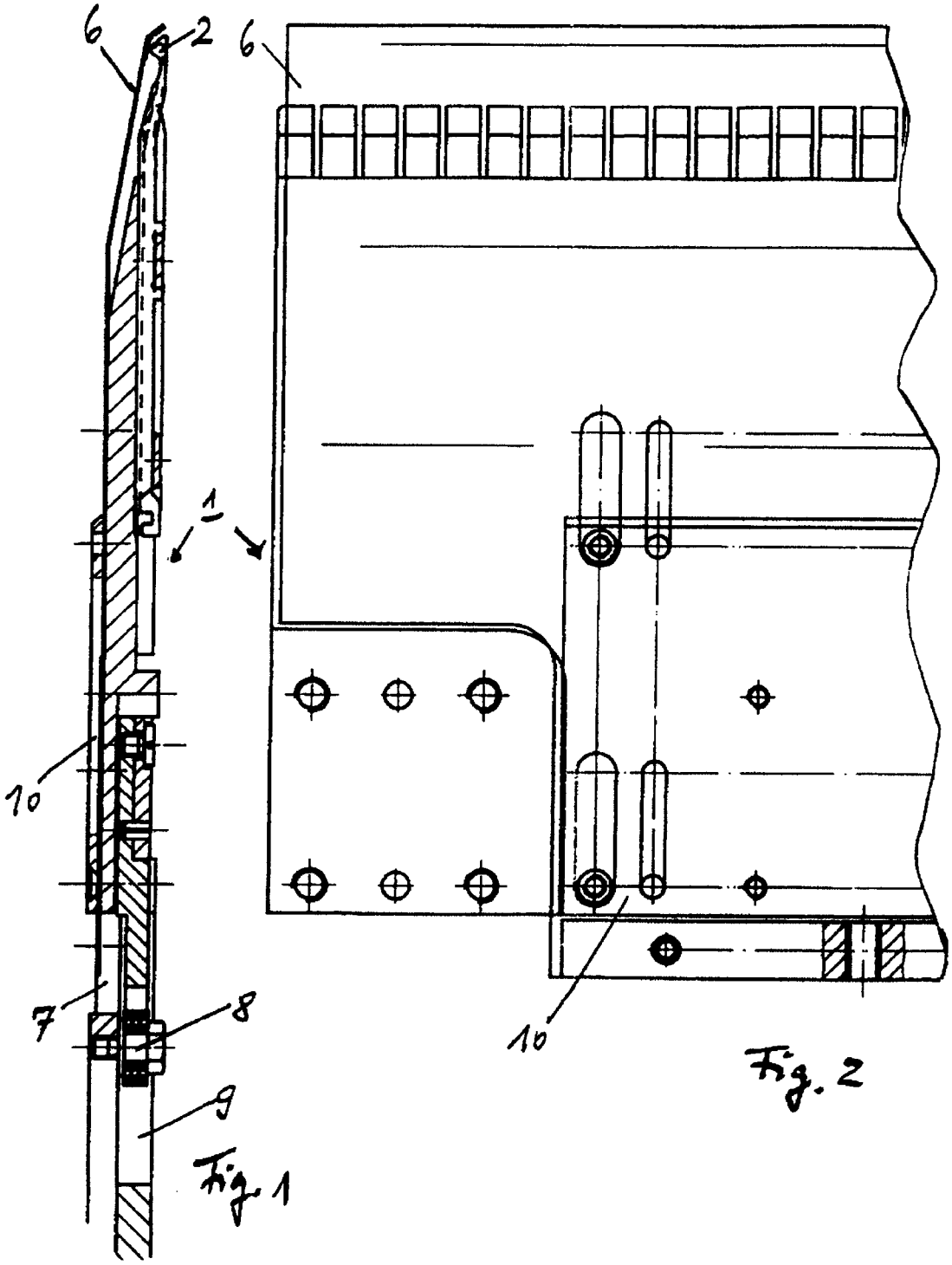
FIG. 1 shows a schematic section through a take-off comb incorporating a take-off comb covering device in accordance with the invention, FIG. 2 a partial side view of the device illustrated in sectional form in FIG. 1, FIG. 3 a schematic illustration of a comb hook hanging in the fabric in the form of a partial side and sectional view, and FIG. 4 the comb hook illustrated in FIG. 3 in a position for pressing off the fabric.
Figure 3:
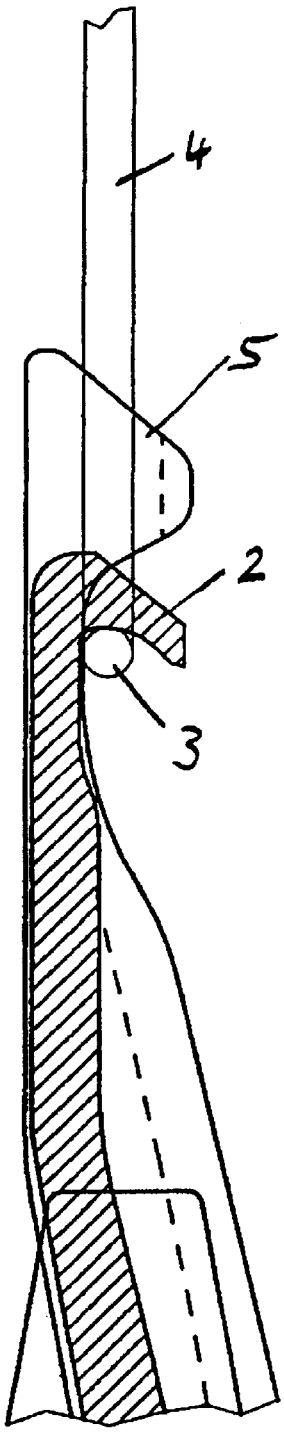
Figure 4:
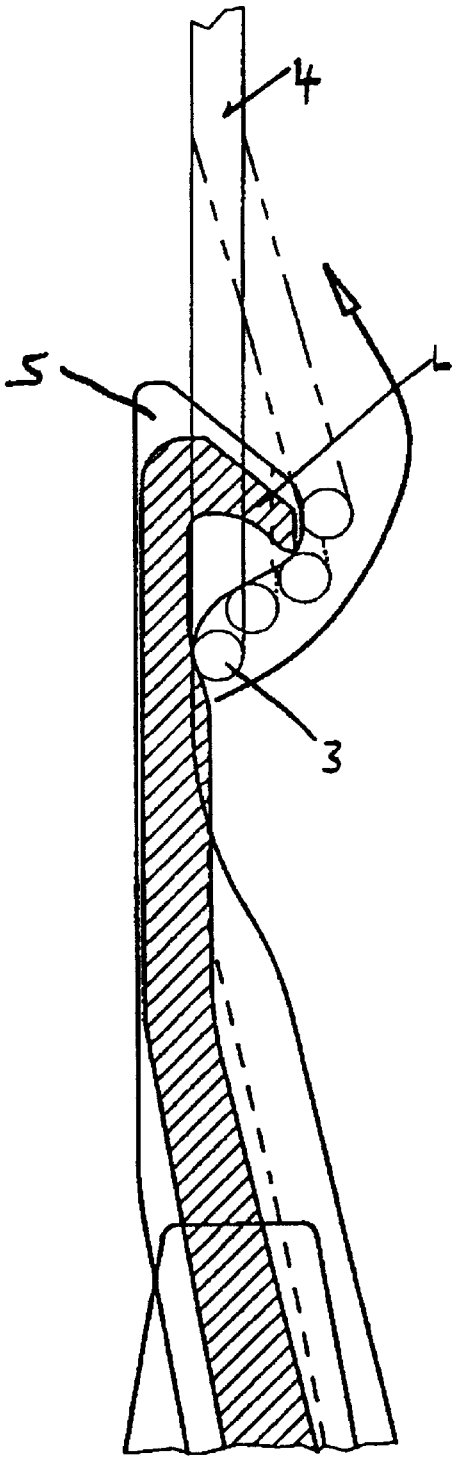

The take-off comb 1 illustrated in FIGS. 1 and 2 is arranged below the knitting area of the two needle beds of a not-illustrated flatbed knitting machine and is moveable in controlled manner in the pull-off direction or in the direction opposed thereto. At its upper end, the take-off comb comprises comb hooks 2 which are also illustrated schematically in FIGS. 3 and 4 so as to provide a clearer picture. During the upward movement of the take-off comb, the comb hooks 2 are hooked into the stitches 3 of a fabric 4 and pull this fabric 4 down until it can be seized by an upper and/or lower fabric take-off device. For clarity, this device is not illustrated but is known e.g. from the book by F. Raz mentioned hereinabove. Following this step which is illustrated in FIG. 3, the fabric 4 is pressed off by effecting a relative movement between the comb hook 2 and an ejecting element 5 (c.f. the arrowed line in FIG. 4) i.e. the comb hook 2 enters the ejecting element which then closes off the comb hook 2 for the stitches 3 and allows them to slide off the take-off comb (c.f. FIG. 4). The ejection range of the ejecting element 5 extends on each side of the comb hook 2.

In order to prevent the previously knitted part from getting caught up by the take-off comb 1 during the upward movement thereof into its working position, the flatbed knitting machine in accordance with the invention comprises a take-off comb covering device 6 which is in the form of a covering plate in the embodiment illustrated. In the illustration of FIGS. 1 and 2, the covering plate 6 is in a position in which the comb hooks are covered i.e. in a position occurring during the upward movement of the take-off comb 1. The covering plate 6 extends substantially in parallel with the take-off comb 1 down to a point where it is attached to a displacing element 7. This element comprises a projection, a pin or a screw 8 which passes through a slot 9 in the take-off comb 1 and is moveable upwardly or downwardly relative thereto. A plate 10 is located on the side of the covering plate 6 remote from the take-off comb 1 for the purposes of guiding and retaining the covering plate 6 which is moveable upwardly or downwardly relative to the take-off comb 1 between said plate 10 and said comb 1.

The covering plate 6 is carried along with this assembly during the upward movement of the take-off comb 1 into its working position thereby completely covering the comb hooks 2 in the manner illustrated in FIG. 1. Once this upward movement of the take-off comb 1 has continued so far that a previously knitted fabric will no longer be present in the vicinity of the comb hooks 2, and the comb hooks have reached the position at which they are to perform their pull-off function i.e. they have to be hooked into the stitches of the subsequent fabric, there is a relative movement between the take-off comb 1 and the covering plate which is such that the covering plate 6 has its upward movement stopped while the take-off comb 1 and the comb hooks 2 continue to be lifted. The comb hooks 2 are thereby freed from the covering plate 6 and can perform their allotted function. The ending of the upward movement of the covering plate 6 is simply achieved by means of a not-illustrated stop element provided on the displacing element 7, whereby said element strikes a corresponding fixed dog on the flatbed knitting machine and thereby prevents any further upward movement of the covering plate 6.

The invention has been described hereinabove on the basis of a preferred embodiment. However, it is possible for the skilled person to make numerous modifications and alterations without thereby departing from the basic principle of the invention.

What is claimed is:

1. A flatbed knitting machine including at least two needle beds, at least one knitting system, at least one fabric take-off device and a take-off comb (1) which comprises comb hooks (2) and at least one ejecting element (5) for pressing off a knitted fabric (4), characterised by a take-off comb covering device (6) which is controllably moveable relative to the take-off comb (1) and the ejecting element (5) and which covers the comb hooks (2) during at least one part of a rising motion of the take-off comb (1).

2. A flatbed knitting machine in accordance with claim 1, characterised in that the take-off comb covering device (6) is resilient and snaps over the comb hooks (2) when the take-off comb is covered.

3. A flatbed knitting machine in accordance with claim 1, characterised in that the take-off comb covering device comprises a cover plate (6).

4. A flatbed knitting machine in accordance with claim 1, characterised in that the take-off comb covering device (6) and the take-off comb (1) are mutually, relatively moveable in the take-off direction.

5. A flatbed knitting machine in accordance with claim 1, characterised in that the comb hooks (2) are not covered by the take-off comb covering device (6) during the downward motion of the take-off comb (1).

* * * * *